US007614442B2

(12) United States Patent
Colling

(10) Patent No.: US 7,614,442 B2
(45) Date of Patent: Nov. 10, 2009

(54) HEAT EXCHANGER

(75) Inventor: Morgan Colling, Hölö (SE)

(73) Assignee: Scania CV AB (publ) (SE)

( * ) Notice: Subject to any disclaimer, the term of this patent is extended or adjusted under 35 U.S.C. 154(b) by 344 days.

(21) Appl. No.: 11/574,004

(22) PCT Filed: Jun. 28, 2005

(86) PCT No.: PCT/SE2005/001015

§ 371 (c)(1),
(2), (4) Date: Feb. 20, 2007

(87) PCT Pub. No.: WO2006/019344

PCT Pub. Date: Feb. 23, 2006

(65) Prior Publication Data

US 2009/0025920 A1 Jan. 29, 2009

(51) Int. Cl.
*F28F 13/08* (2006.01)

(52) U.S. Cl. ..... 165/147; 165/165; 165/173

(58) Field of Classification Search ..... 165/146, 165/147, 165, 166, 173, 175
See application file for complete search history.

(56) References Cited

U.S. PATENT DOCUMENTS 1,454,107 A * 5/1923 Curran ..... 165/153
1,458,128 A * 6/1923 Curran ..... 165/153
1,825,321 A * 9/1931 La Mont et al. ..... 165/147
2,613,065 A * 10/1952 Didier ..... 165/146
4,338,993 A * 7/1982 Fernstrum ..... 165/44
4,765,397 A * 8/1988 Chrysler et al. ..... 165/104.33
5,002,123 A * 3/1991 Nelson et al. ..... 165/147
5,072,787 A * 12/1991 Nakamichi ..... 165/80.3
5,697,435 A * 12/1997 Stickford et al. ..... 165/146
6,125,926 A * 10/2000 Okamoto et al. ..... 165/166
6,935,419 B2 * 8/2005 Malone et al. ..... 165/185
2001/0025705 A1 * 10/2001 Nash et al. ..... 165/167
2004/0149425 A1 * 8/2004 Abiko et al. ..... 165/166

* cited by examiner

*Primary Examiner*—Allen J Flanigan
(74) *Attorney, Agent, or Firm*—Ostrolenk Faber LLP

(57) ABSTRACT

A heat exchanger comprising two tanks, and a plurality of tubes for a medium which is to be cooled/heated are arranged in stacked, transverse rows, with the tubes arrayed to extend from the entrance to the exit side of the heat exchanger. The tubes are disposed between and transmit the medium between the tanks. Ducts between the stacked rows of the tubes for flow of a different cooling/heating medium. The ducts are arranged to run transversely to the longitudinal direction of the tubes. The opposing connection surfaces of the tanks converge in the direction of flow of the cooling/heating medium through the heat exchanger. The ducts closer to the connection surfaces are angled convergingly like the connection surfaces. Such a heat exchanger may be used, e.g. as a cooler, and in a motor vehicle.

6 Claims, 2 Drawing Sheets

HEAT EXCHANGER

CROSS REFERENCE TO RELATED APPLICATION

The present application is a 35 U.S.C. §§ 371 national phase conversion of PCT/SE2005/001015, filed Jun. 28, 2005, which claims priority of Swedish Application No. 0402033-5, filed Aug. 8, 2004. The PCT International Application was published in the English language.

TECHNICAL FIELD OF THE INVENTION

The invention relates to a heat exchanger comprising two tanks, and tubes for medium which is to be cooled/heated are arranged to extend in the longitudinal directions of the tubes, which is laterally, between connection surfaces of the tanks and the tubes are connected into the tanks. The tubes are in a stack. Each level in the stack has a row of the tubes extending between the tanks. The levels in the stack are spaced apart. There are ducts between the stacked rows of tubes for passage through the ducts of cooling/heating medium. In some embodiments the ducts are arranged to run at an angle oblique to the longitudinal direction from the entrance to the exit side of the heat exchanger. In some embodiments, the ducts nearer to the connection surfaces of the tanks generally approach the oblique angle of the connection surfaces. The invention also relates to the use of such a heat exchanger, e.g. as a cooler, in a motor vehicle.

BACKGROUND

It is desirable to provide a heat exchanger with a maximum effective heat transfer area. Achieving a larger heat transfer area has previously entailed increasing the dimensions of the heat exchanger, but it is desirable to achieve this increase in effective area without increasing the overall dimensions of the heat exchanger.

Particularly in the vehicle industry, available space for a heat exchanger in the front of the vehicle is extremely limited. In the case of a truck, the space is often limited upwards by the cab and sideways and downwards by, for example, various frames and members. To accommodate a larger heat exchanger, the vehicle has quite simply to be made larger, which is not only more expensive but also leads to a bulkier vehicle, which is undesirable for several reasons, e.g. rules on maximum sizes of vehicles, or shortage of space at places where the vehicle is likely to operate.

SUMMARY OF THE INVENTION

The object of the present invention is to provide a heat exchanger with increased effective heat transfer area while maintaining the same overall dimensions.

This is achieved by a heat exchanger comprising two tanks and tubes for medium which is to be cooled/heated arranged to extend between connection surfaces of the tanks and are connected to the tanks. A pump driven by an engine moves a medium through the tubes from one tank to the other to expose medium in the tubes to the other medium flowing through ducts past the tubes. There are ducts between the stacked rows tubes for cooling/heating medium and the ducts are arranged to run at an angle to the to the connection surfaces of the tanks and across the longitudinal direction of the tubes. The connection surfaces are arranged to converge in the direction of flow of the cooling/heating medium in the ducts.

The ducts closer to the connection surfaces gradually approach the convergence angle of the respective connection surface.

The result as viewed in the direction of flow of the cooling/heating medium is increased upstream area of the heat exchanger, i.e. the first area which the cooling/heating medium encounters when it reaches the heat exchanger and enters the ducts. This area is most effective with regard to heat transfer, since the temperature difference between the cooling/heating medium in the ducts and the medium in the tubes which is to be cooled/heated is greatest precisely when the cooling/heating medium reaches the aperture to the heat exchanger's ducts for the cooling/heating medium. Increasing the most effective area for heat transfer makes it possible to increase the cooling/heating capacity ofthe heat exchanger while maintaining the same overall dimensions of the heat exchanger.

The connection surfaces of the tanks are preferably arranged to converge in such a way that the upstream tubes in a row at each level in the stack of tubes, as viewed in the direction of flow of the cooling/heating medium, extends across, in principle, the whole width of the heat exchanger, and in such a way that the downstream tubes in a row, as viewed in the direction of flow of the cooling/heating medium, extends across a portion of the width of the cooler/heater which allows the tanks to be of sufficient size.

The result is maximum utilisation of the heat exchanger's width for heat transfer while at the same time catering for the necessary size of tanks.

With advantage, the flow ducts in a region close to the respective tanks are angled relative to other flow ducts for the cooling/heating medium, in such a way that the flow ducts in these regions of increasing proximity to the respective connection surface run increasingly parallel with the connection surfaces.

Optimum air flow conditions through the heat exchanger can thus be achieved.

To prevent waste in the making of heat exchangers according to the invention, the connection surfaces may with advantage converge at, in principle, an angle of 45° to the longitudinal direction of the tubes.

This makes it easy to use all cut tubes by turning them in different directions, without further machining which would take time and generate unnecessary waste.

The invention also relates to the use of a heat exchanger as above in a motor vehicle. The heat exchanger is particular suitable for use in vehicles, such as trucks, in which space is limited by surrounding components. The heat exchanger can thus be used as, for example, a water cooler, a charge air cooler or as a component of the air conditioning system.

DESCRIPTION OF THE DRAWINGS

The invention is described below with reference to the attached drawings, in which.

DESCRIPTION OF EMBODIMENTS

Figure 1:
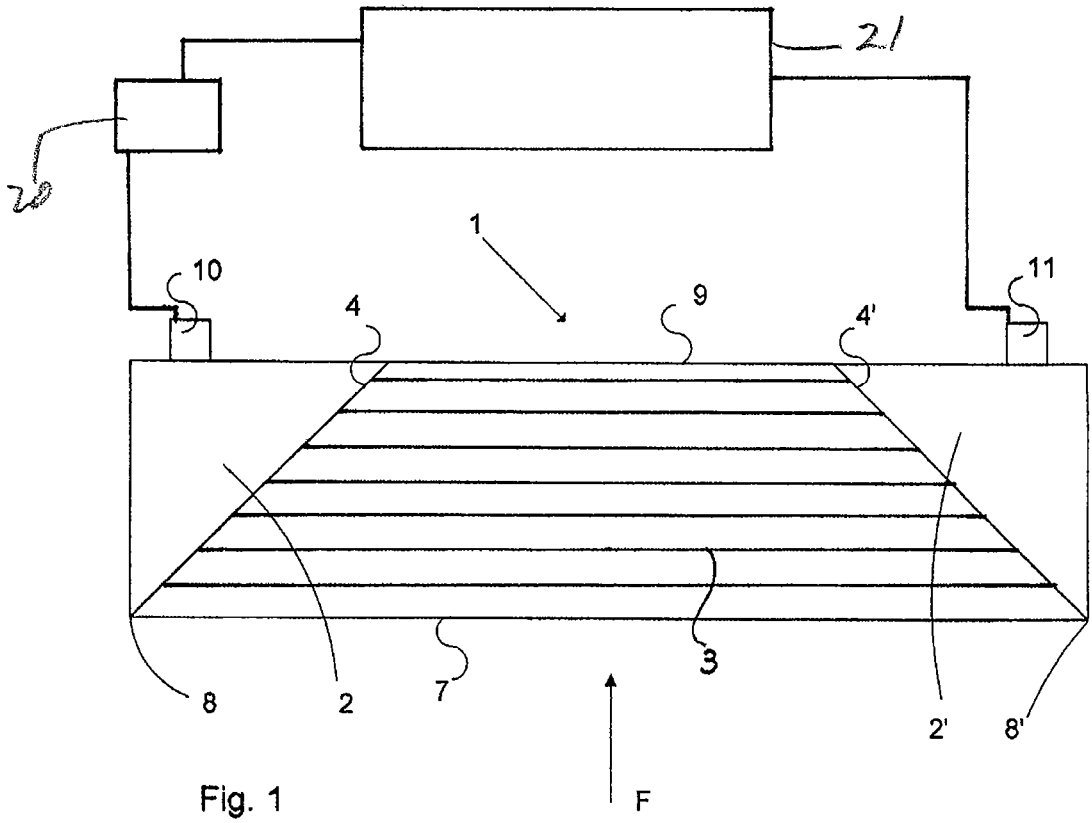
FIG. 1 depicts schematically a heat exchanger according to a preferred embodiment of the invention as viewed from above at 2-2.
Figure 3:
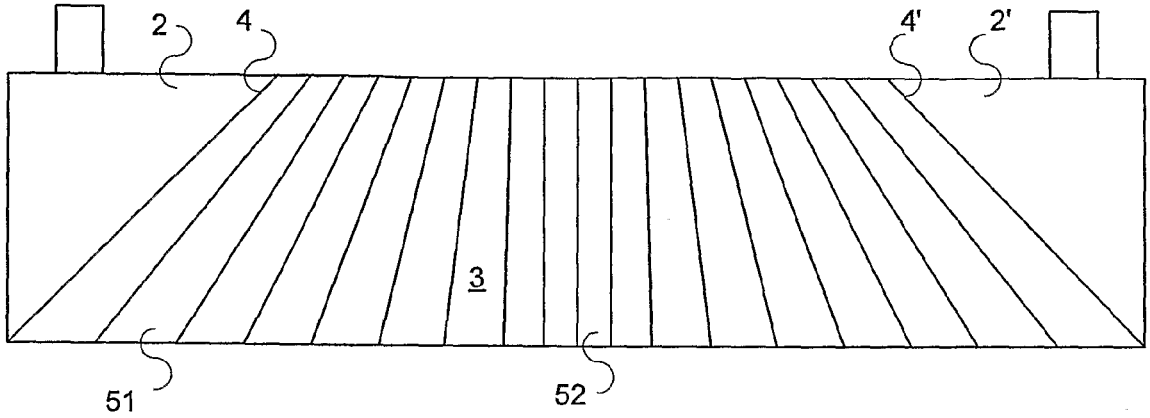
FIG. 3 is a schematic cross-section from above of a heat exchanger according to a preferred embodiment of the invention.

The heat exchanger 1 comprises two tanks 2, 2'. Tubes 3 for medium to be cooled/heated are arranged to extend between connection surfaces 4, 4' of the tanks 2, 2', and each tube is fluid flow connected to both tanks. The tubes are in a vertical array or stack, each level in the stack having rows of tubes, and the rows are spaced apart vertically. As seen in FIG. 1, each row of tubes in the stack is comprised of a plurality of tubes extending across the heat exchanger between the connection surfaces 4, 4', in the longitudinal direction of the tubes. A pump 20 connected with an engine 21 communicates with the tanks to move the medium between the tanks. Ducts 5 for cooling/heating medium are arranged to run in a flow direction past all tubes in each row and, as seen in FIG. 3, at an angle to the longitudinal direction through the heat exchanger. The ducts 5 are made up in a conventional manner of flanges 6, or thin plate like elements, or the like arranged to open at the tubes 3 above and between each duct. The connection surfaces 4, 4' are arranged to converge in the direction of flow of the cooling/heating medium. The direction of flow of the cooling/heating medium is represented in FIG. 1 by an arrow F from the upstream side 7 to the downstream side 9 of the heat exchanger.

Figure 2:
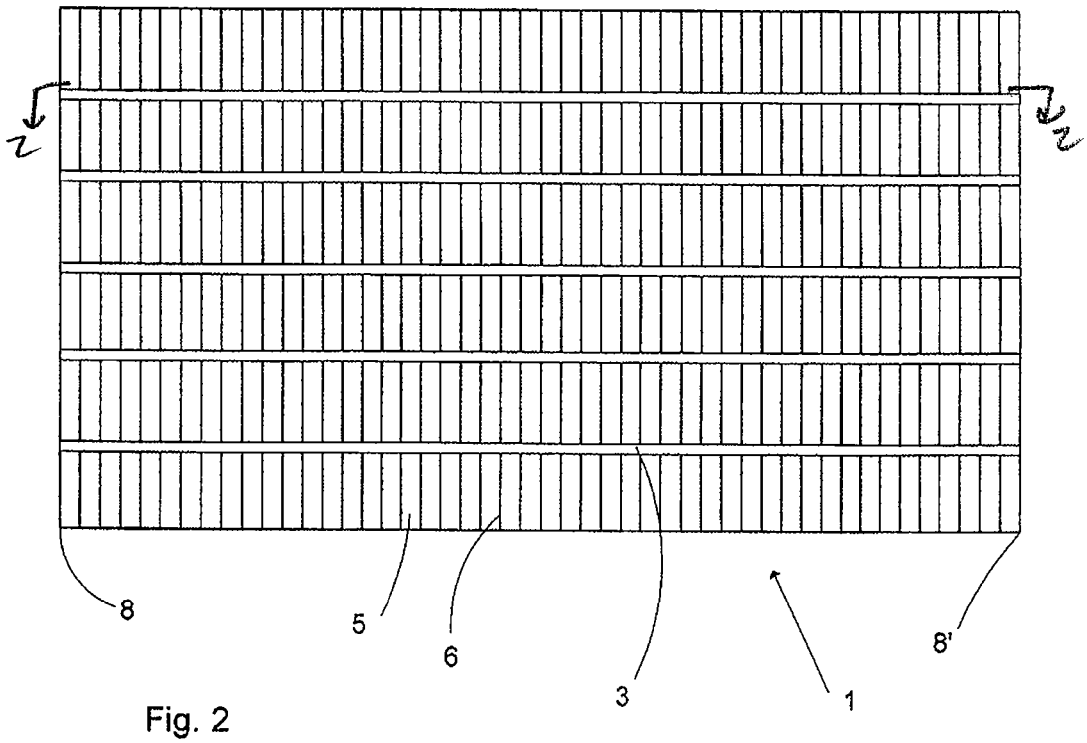
FIG. 2 depicts schematically a heat exchanger according to a preferred embodiment of the invention as viewed from in front.

As may be seen in FIGS. 1 and 2, the connection surfaces 4, 4' converge in such a way that the upstream side 7 of the row of tubes 3, as viewed in the direction of flow of the cooling/heating medium, extend across, in principle, the whole width of the heat exchanger 1, i.e. from a corner 8 of one tank 2 to the corresponding corner 8' of the second tank 2'. The upstream side 7 includes the first tubes 3 in each row in a stack which the cooling/heating medium encounters when it reaches the heat exchanger 1. Depending inter alia on the viscosity and other flow characteristics of the medium in the tubes which is to be cooled/warmed, more space may be needed at the corners 8, 8', in which case these corners may be made less sharp than in FIG. 1.

The connection surfaces 4, 4' also converge in such a way that the downstream side 9 of the row of tubes 3, as viewed in the direction of flow of the cooling/heating medium, extends across a portion of the heat exchanger's width which allows the tanks 2, 2' to be of sufficient size. Sufficient size usually means the tanks are of the same volume which corresponding tanks would have in a heat exchanger which has the same overall dimensions and which tanks have, in principle, parallel connection surfaces.

In the drawings, the connection surfaces 4, 4' are straight, but there may be applications in which these surfaces have with advantage a different shape, e.g. convex or concave. The design of the tanks 2, 2' may also vary. Their functions include even distribution among the tubes 3 of medium which is to be cooled/heated. The magnitude of their cross-section may therefore be varied in a vertical direction in order to ensure optimum distribution.

As may be seen in FIG. 3, the flow ducts 51 in a region close to the respective tanks 2, 2' are angled relative to other flow ducts 52 for the cooling/heating medium, so that the flow ducts 51 in these regions run increasingly parallel with the connection surface 4, 4' of the respective tank 2, 2' the closer the ducts 51 of the respective tank 2, 2' are arranged. The other flow ducts 52 run, in principle, perpendicular to the longitudinal direction of the tubes 3.

Figure 4:
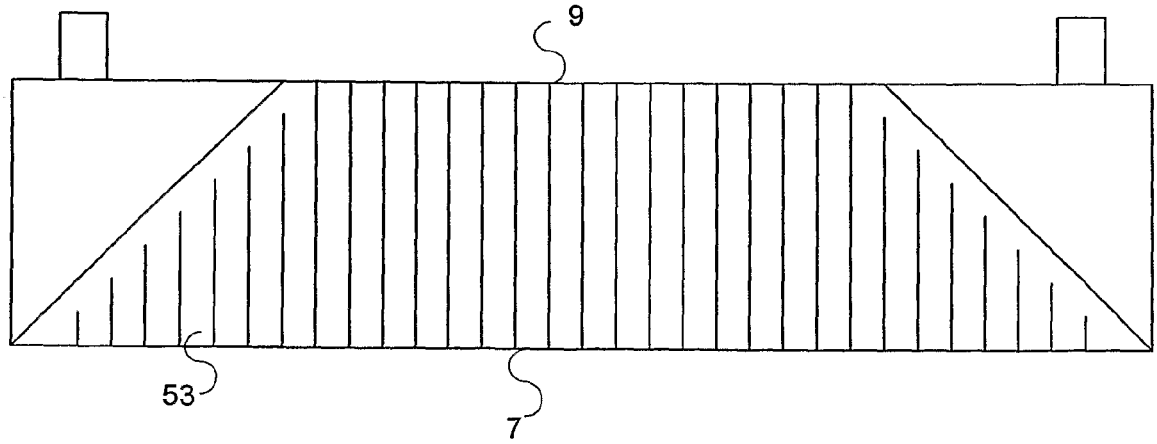
FIG. 4 is a schematic cross-section from in front of a heat exchanger according to a second preferred embodiment of the invention.

FIG. 4 depict schematically an embodiment in which the ducts 53, in the region close to the respective tank, do not go all the way from the heat exchanger's upstream side 7 to its downstream side 9, as viewed in the direction of flow of the cooling/heating medium.

The embodiments in FIGS. 3 and 4 represent preferred embodiments for enabling the cooling/heating medium to flow through the heat exchanger, i.e. into the ducts 5, 51, 52, 53 on the upstream side 7 of the heat exchanger and out from the ducts 5, 51, 52, 53 on the downstream side of the heat exchanger, with optimum flow conditions.

The connection surfaces 4, 4' preferably converge at, in principle, an angle of 45° to the direction from the upstream 7 to the downstream 9 side and across the longitudinal direction of the tubes 3. This makes it possible, during the manufacture of the heat exchanger 1, for the tubes 3 to be cut without unnecessary waste due to offcuts, because it is easy for the tubes 3 whose ends are cut at an angle of 45° to be turned and used in a stack of rows above one another in the heat exchanger 1.

Where the heat exchanger takes the form of a water cooler for a vehicle, e.g. a truck, the medium to be cooled is radiator fluid, usually a water/glycol mixture, and the cooling medium is ambient air which flows into the ducts 5 when the vehicle is in motion or when the vehicle's fan is running. The radiator fluid is pumped to flow into the one tank 2 via the inlet 10 and out from the second tank 2' via the outlet 11. Where the heat exchanger takes the form of some other kind of cooler or heater, the various media will be those needed for the cooler/heater concerned.

A design as above enables the upstream area of the heat exchanger to be made larger without the overall dimensions of the heat exchanger becoming larger. The upstream area is the area which the cooling/heating medium first encounters, i.e. the forward area of the heat exchanger in cases where it is fitted at the front behind the grille, e.g. on a truck. The upstream area is the most effective heat transfer area, since that is the area of greatest temperature difference between medium which is to be cooled/heated and the cooling/heating medium. For a given overall size of heat exchanger, the invention thus results in a more effective heat transfer.

What is stated above is merely an example by way of illustration and does not limit the scope of the invention. The scope of protection is only limited by the claims set out below. Thus the heat exchanger may take the form of a heat exchanger other than a water cooler for a vehicle, e.g. it may take the form of a charge air cooler or of a heat exchanger in the vehicle's air conditioning system. Nor is the invention limited to vehicles, as it may also be applied in, for example, passenger vehicles, construction machines and any other kind of vehicle desired, and also outside the vehicle sector, e.g. in air conditioning systems.

The invention claimed is:

1. A heat exchanger for cooling or heating a first medium comprising:

the heat exchanger having an upstream entrance side and a downstream exit side for a second heating or cooling medium to flow through the heat exchanger, into the upstream entrance side and out the downstream exit side, the heat exchanger having opposite lateral sides;

a respective tank for the first heating or cooling medium, each tank located at a respective one of the opposite lateral sides of the heat exchanger; each tank having a connection surface on a side of the tank opposing the other tank;

tubes for the first medium which is to be cooled/heated, the tubes extending in a longitudinal direction between the tanks; the tubes being arranged in a stack with levels and each level including a row of the tubes, each row extending from the entrance side to the exit side of the heat exchanger and arranged across a space between the connection surfaces of the tanks;

a plurality of flow ducts between the rows of the tubes in the stack for the second cooling/heating medium, the ducts are arranged to run across the longitudinal direction of the tubes and at an angle to the connection surfaces and are oriented to converge in the direction of flow of the second cooling/heating medium;

the respective flow ducts located in a region closer to each of the tanks are angled relative to others of the flow ducts such that the flow ducts in regions of increasing proximity to the respective connection surfaces of the tanks run increasingly parallel to the respective connection surfaces.

2. A heat exchanger according to claim 1, wherein the connection surfaces are oriented to converge such that an upstream portion of each row of the tubes in the direction of flow of the second cooling/heating medium extends across generally the entire width of the heat exchanger between the lateral sides.

3. A heat exchanger according to claim 2, wherein the connection surfaces are oriented to converge such that a downstream portion of each row of the tubes in the direction of flow of the second cooling/heating medium extends across a portion of the width of the heat exchanger which selected to allow the tanks to be of sufficient size for the first medium to be heated/cooled.

4. A heat exchanger according to claim 1, wherein the connection surfaces converge at an angle of 45° to the longitudinal direction to the tubes.

5. A heat exchanger for cooling or heating a first medium comprising:

the heat exchanger having an upstream entrance side and a downstream exit side for a second heating or cooling medium to flow through the heat exchanger, into the upstream entrance side and out the downstream exit side, the heat exchanger having opposite lateral sides;

a respective tank for the first heating or cooling medium, each tank located at a respective one of the opposite lateral sides of the heat exchanger; each tank having a connection surface on a side of the tank opposing the other tank;

tubes for the first medium which is to be cooled/heated, the tubes extending in a longitudinal direction between the tanks; the tubes being arranged in a stack with levels and each level including a rows of the tubes, each row extending from the entrance side to the exit side of the heat exchanger and arranged across a space between the connection surfaces of the tanks;

a plurality of flow ducts between the rows of the tubes in the stack for the second cooling/heating medium, the ducts are arranged to run across the longitudinal direction of the tubes, a respective group of the ducts at each lateral side toward the tanks extending toward intersection with the connection surfaces but stopping a distance from the connecting surfaces thereby together defining a duct extending in the same direction as the connection surface.

6. A heat exchanger as claimed in claim 5, wherein the respective ducts extending towards the connection surfaces are reduced in length to end in a common path, and the path is essentially parallel to and defines respective connecting surface extending ducts, running at an angle to a longitudinal path from the upstream entrance side of the heat exchanger to the downstream exit side.

* * * * *